United States Patent [19]

Evans

[11] 4,431,238

[45] Feb. 14, 1984

[54] CABINET FOR STORING AND SELECTIVELY DISPENSING A VARIETY OF PAPER SUPPLIES

[75] Inventor: Gary L. Evans, La Palma, Calif.

[73] Assignee: Keyrack Company, Inc., Paramount, Calif.

[21] Appl. No.: 309,237

[22] Filed: Oct. 7, 1981

[51] Int. Cl.[3] ..... E21B 49/00

[52] U.S. Cl. ..... 312/184; 312/59; 312/125; 312/196; 312/252; 312/305

[58] Field of Search ..... 312/125, 135, 186, 196, 312/252, 305, 184, 185; 226/110; 271/145

[56] References Cited

U.S. PATENT DOCUMENTS

| | | | |
|---|---|---|---|
| 833,775 | 10/1906 | Clements | 312/305 X |
| 1,559,705 | 11/1925 | Jackson | 312/305 X |
| 2,830,708 | 4/1958 | Miller | 211/45 X |
| 3,850,488 | 11/1974 | Elias et al. | 211/45 X |
| 3,982,800 | 9/1976 | Gorton et al. | 312/135 X |
| 4,345,803 | 8/1982 | Heck | 312/196 |

FOREIGN PATENT DOCUMENTS

| | | | |
|---|---|---|---|
| 6202 | 11/1894 | Sweden | 211/45 |

*Primary Examiner*—William E. Lyddane
*Assistant Examiner*—Joseph Falk
*Attorney, Agent, or Firm*—Harlan P. Huebner

[57] ABSTRACT

A cabinet for storing and selectively dispensing a variety of paper supplies in web form carries separate boxes of webs on vertically spaced decks of a turntable within the cabinet. The boxes on one deck are offset with respect to the boxes on the other deck so that webs from the lower deck can pass upward between boxes on the upper deck. The ends of webs from all the boxes are held at a common level adjacent the under side of the cabinet top, and a slot in the top permits withdrawal of any web as it is aligned with the slot by rotating the turntable.

3 Claims, 7 Drawing Figures

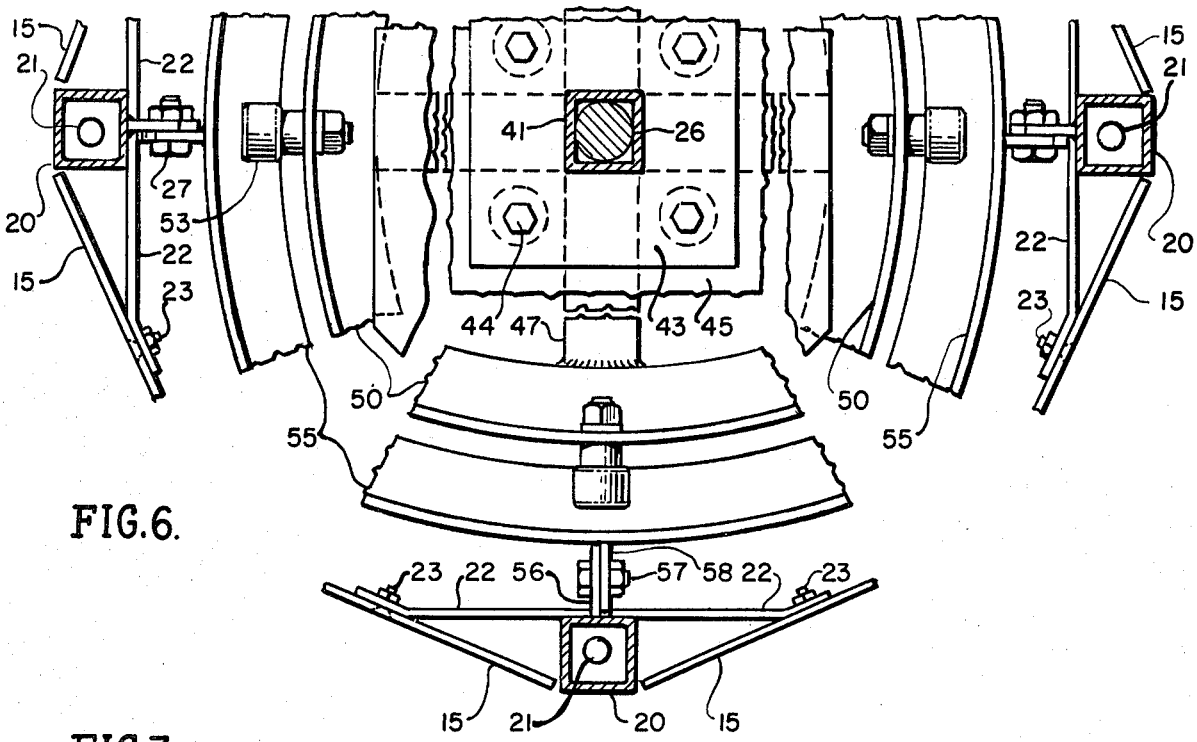
FIG.6.
FIG.7.
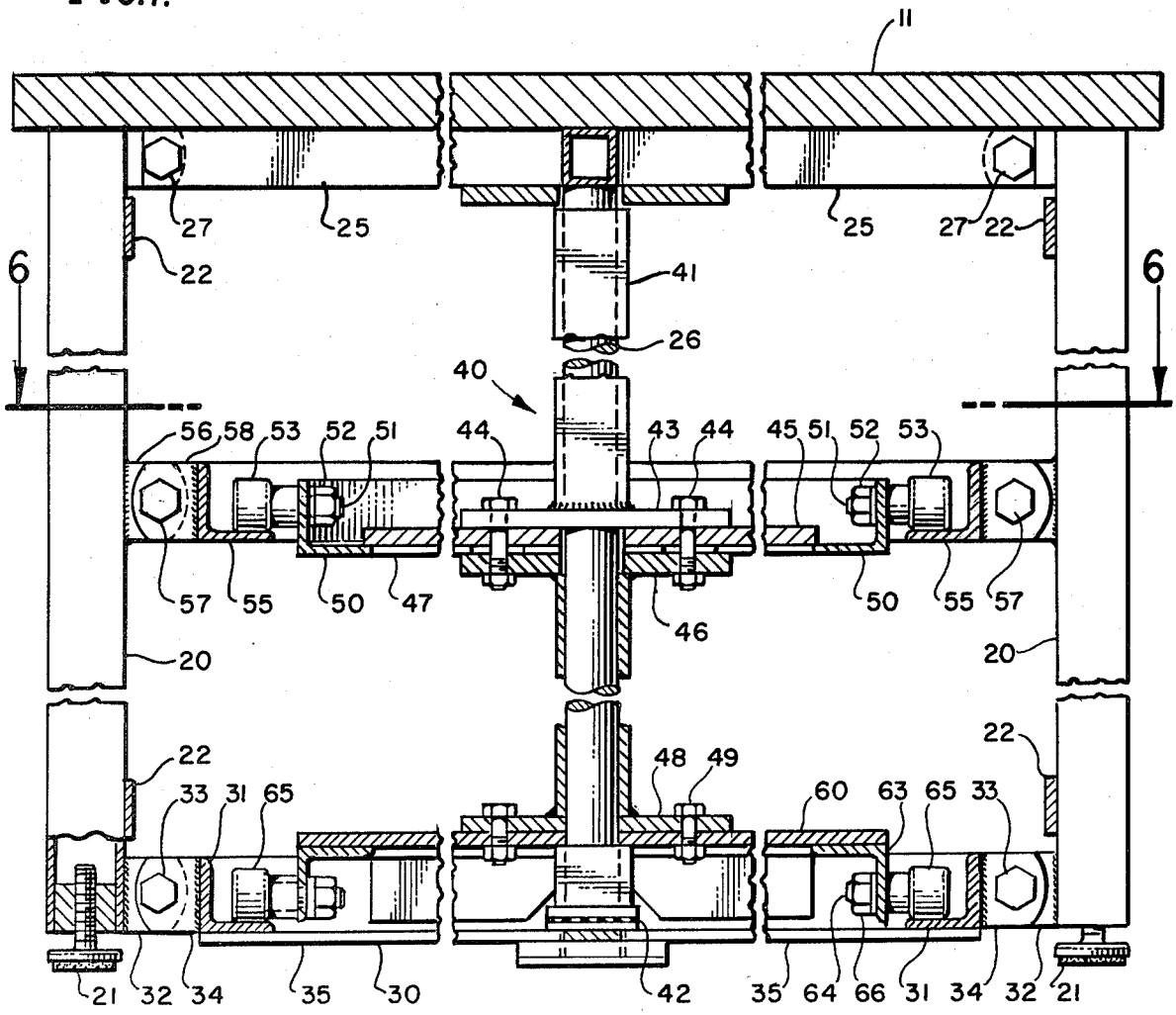

CABINET FOR STORING AND SELECTIVELY DISPENSING A VARIETY OF PAPER SUPPLIES

BACKGROUND OF THE INVENTION

1. Field of the Invention

The present invention relates to cabinet structures and more particularly to a special-purpose cabinet designed to support the printer of a computer system and to selectively supply a variety of paper to said printer.

2. Description of the Prior Art

Modern computer systems are employed to produce individually printed invoices, checks, statements and the like and for each such item a different paper printed form must be supplied to the printer of the computer system. Each time a different form is used, it is necessary to remove the form previously fed into the printer, moving that form's heavy box aside, place the new forms' heavy box behind the printer, and feed the new form into the printer. This is inconvenient, time-consuming and usually results in several open boxes of forms being stacked around the printer.

The cabinet structure of the present invention makes it possible for a number of different webs of paper printed forms in their boxes to be loaded into a cabinet upon which the printer is supported and then easily to feed any of the forms selectively through the upper portion of the cabinet into the printer, and easily returned into the cabinet interior when another form is to be fed into the printer.

SUMMARY OF THE INVENTION

The advantages of the present invention are achieved by providing a cabinet presenting on its upper surface a station for the printer of a computer system. Rotatably supported within the cabinet is a turntable having stations for carrying a plurality of boxes of webs of paper pre-printed forms which are to be fed selectively into the printer. These boxes are placed on the turntables through a door in the cabinet, and any selected web of forms is fed from its box to the printer through a slot in the upper part of the cabinet; its box being first brought adjacent the slot by rotation of the turntable. The free leading edge of each web of forms is held in an elevated position with respect to its box so as to be conveniently accessible through the slot when its box is positioned beneath the slot.

BRIEF DESCRIPTION OF THE DRAWINGS

FIG. 6 is a view in horizontal section taken on the lines 6—6 of FIGS. 2 and 7 with parts broken away for dimensional compression.

FIG. 7 is a view in vertical section taken on the line 7—7 of FIG. 1 with parts broken away for dimensional compression.

DESCRIPTION OF THE PREFERRED EMBODIMENT

Figure 1:
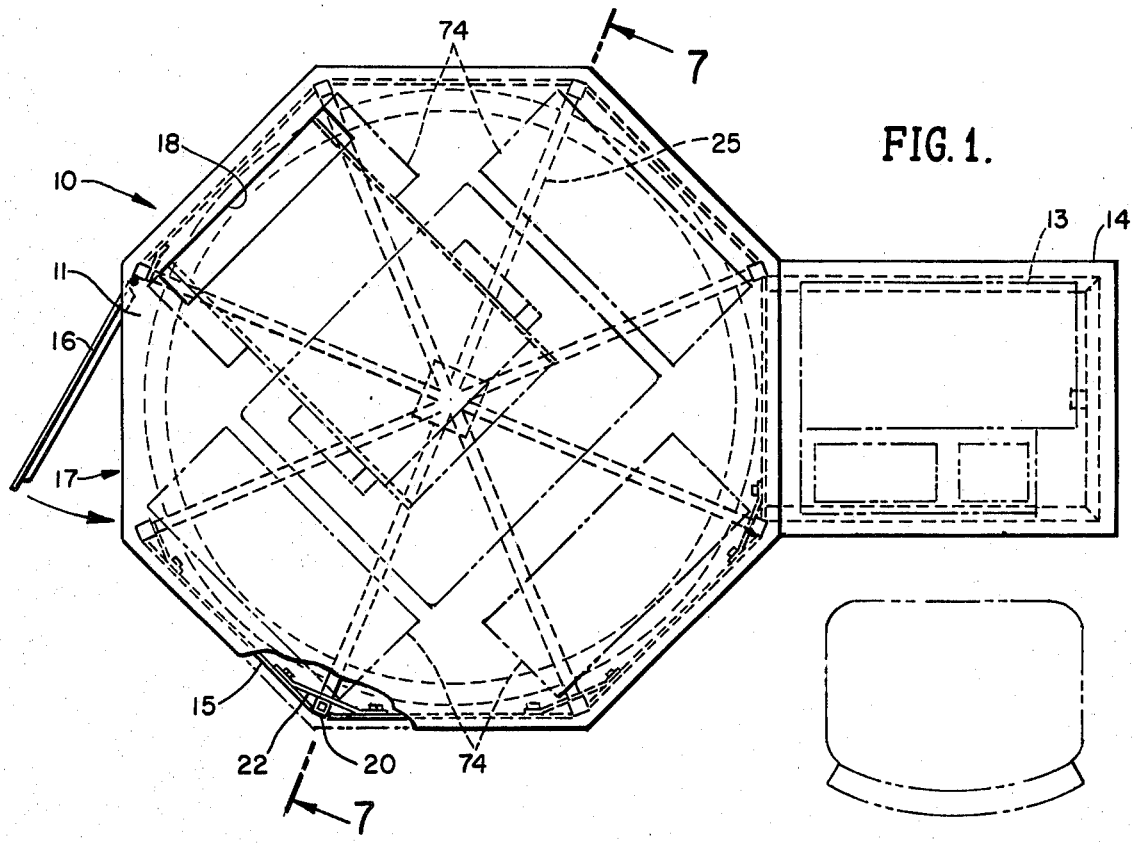
FIG. 1 is a view in plan of a cabinet embodying the present invention with an operator's console station annexed.
Figure 2:
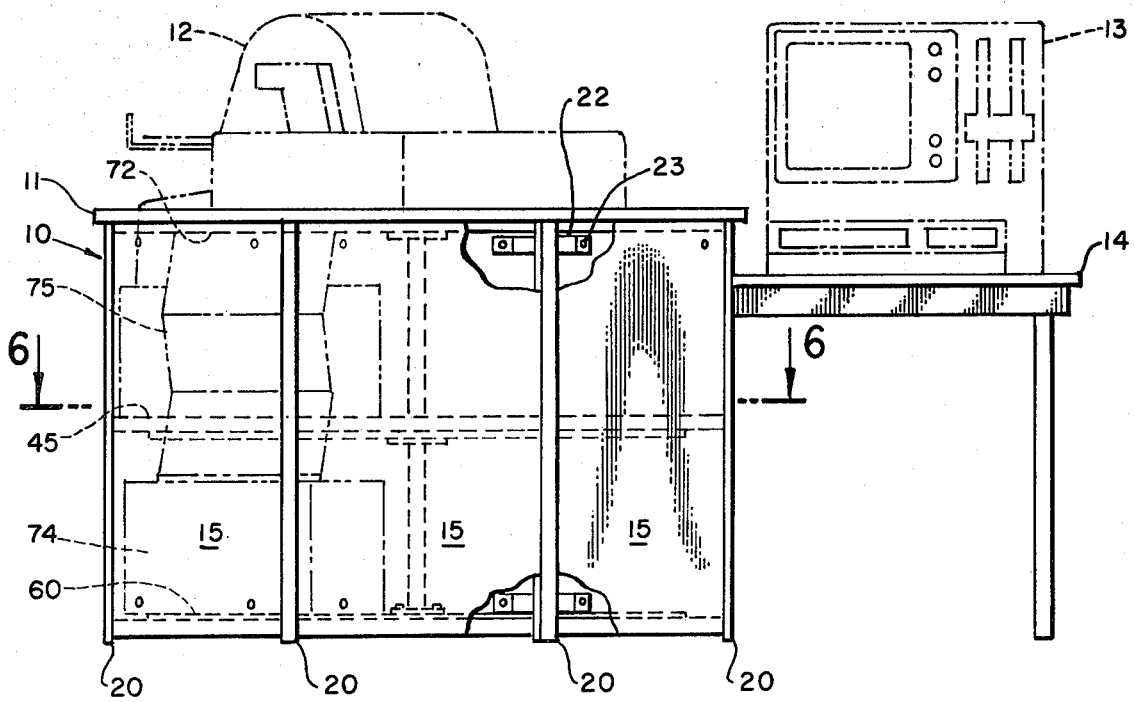
FIG. 2 is a view in frontal elevation of the cabinet and station of FIG. 1 with the operator's console and printer shown in broken lines.

As shown in FIGS. 1 and 2 the cabinet of the present invention comprises an enclosure 10 presenting a horizontal top 11 adapted to support the printer 12 of a computer system which also includes an operator's console 13 carried on an adjacent table 14. Enclosure 10 is octagonal and is provided on each of its sides with vertical side enclosure means in the form of panels 15 one of which, designated 16, is hinged to provide an access opening 17 to the interior of the enclosure. The top 11 is provided also with a slot opening 18 adjacent its periphery.

As shown in greater detail in FIGS. 6 and 7, the top 11 is supported by eight legs 20 made of square metal tubing and provided with screw threaded feet 21 for leveling the top 11. Each of the panels 15 is supported at four points by side panel holders 22 welded to the legs 20 and bolted to the panels 15 as at 23.

A top spider frame 25 welded at its center to a cylindrical center tube 26 and having each of its legs bolted as at 27 to an ear welded to a leg 20 reinforces the upper portion of the enclosure 10. Similarly, the bottom portion may be reinforced by a bottom ring 30 which comprises a circular upper roller track 31 carried by ears 32 welded to legs 20 and bolted, as at 33, to ears 34 welded to track 31. Reinforcement also is provided by cross members 35 welded centrally to the tube 26 and at their opposite ends to the circular roller track 31.

Housed within the enclosure 10 is a turntable structure 40 which is rotatably mounted centrally of the interior of the enclosure. For this purpose the structure includes a tube 41 which is square in cross-section, surrounds tube 26 upon which it is rotatable, and is supported at its lower end on a thrust bearing 42. Intermediate its ends the tube 41 has welded to it a plate 43 which, by means of bolt assemblies 44, clamps between itself and a complementary plate 46 a circular upper deck 45.

Desirably, but not essentially, this upper deck support may be strengthened by the provision of cross members 47 which also are clamped between the plates 43 and 46 and which are welded at their outer ends to an upper roller ring 50 carrying on threaded studs 51 secured to the ring by nuts 52, rotatable rollers 53. These rollers ride on a circular upper roller track 55 which is carried by the legs 20 on ears 56 welded to legs 20 and bolted as at 57 to ears 58 welded to track 55.

The tube 41 of the turntable structure 40 also has welded to it adjacent its lower end a plate 48 which by means of bolt assemblies 49 is attached to a circular lower deck 60.

Desirably, but not essentially, this lower deck structure may be strengthened by the provision of a peripheral roller support similar to that described above in connection with the upper deck structure. This support comprises a lower roller ring 63 carrying on threaded studs 64 secured to the ring by nuts 66, rotatable rollers 65. These rollers ride on the lower roller track 31.

The upper deck 45 and lower deck 60 are adapted to carry, in the present embodiment of the invention, four boxes each of webs of pre-printed forms to be fed into the printer 12 of the computer system for completion. For this purpose four circumferentially equally spaced box stations (which may be indicated by markings) are presented on each deck with the stations on one deck offset rotationally forty-five degrees with respect to those on the other deck.

Figure 3:
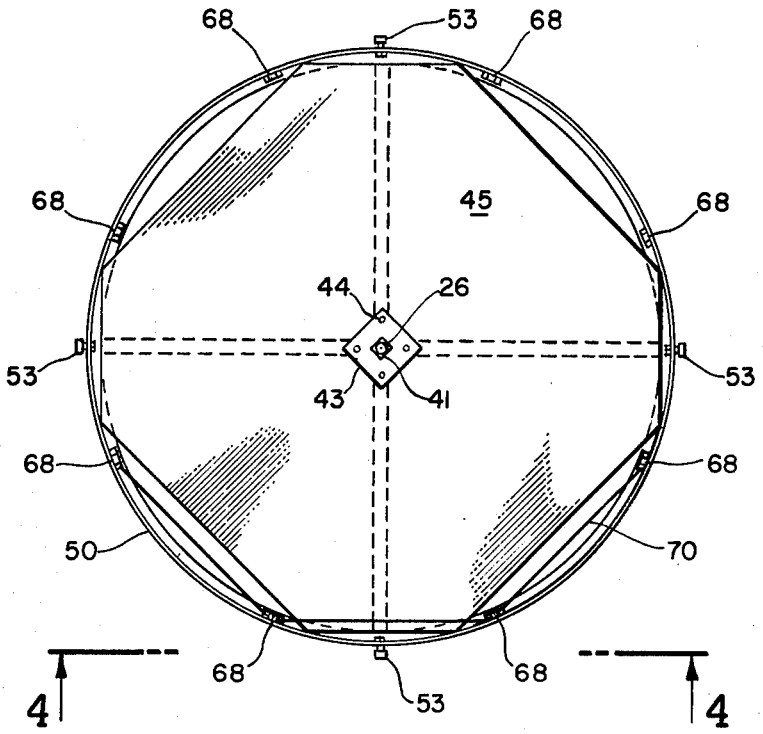
FIG. 3 is a detail view in plan of a turntable deck and associated paper form hangers.

Means are provided for supporting the free end of each web of forms adjacent the periphery of the under side of the top 11 and positioned to come to lie under the slot opening 18 as the turntable is rotated within the enclosure 10. As shown in detail in FIGS. 3, 4 and 5, this means comprises a frame including vertical paper holder supports 68 secured as by riveting to the vertical flange of the upper roller ring 50. Each of the supports 68 is bifurcated as at 69 at its upper end and a paper support rod 70 is passed through the bifurcations of each pair of supports. A pair of clips 71 are carried by each of the rods 70 between each pair of supports 68 for the purpose of holding the free end 72 of a web of forms (shown in broken lines in FIGS. 4 and 5) closely adjacent the under side of top 11 so that, when the free end of any web is beneath the slot opening 18, it and its rod 70 may be grasped, the web may be released from clips 71, and the web then fed into printer 12.

Figure 4:
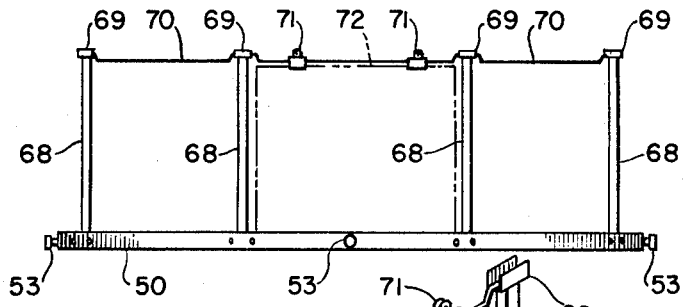
FIG. 4 is a detail view in side elevation of the hangers.
Figure 5:
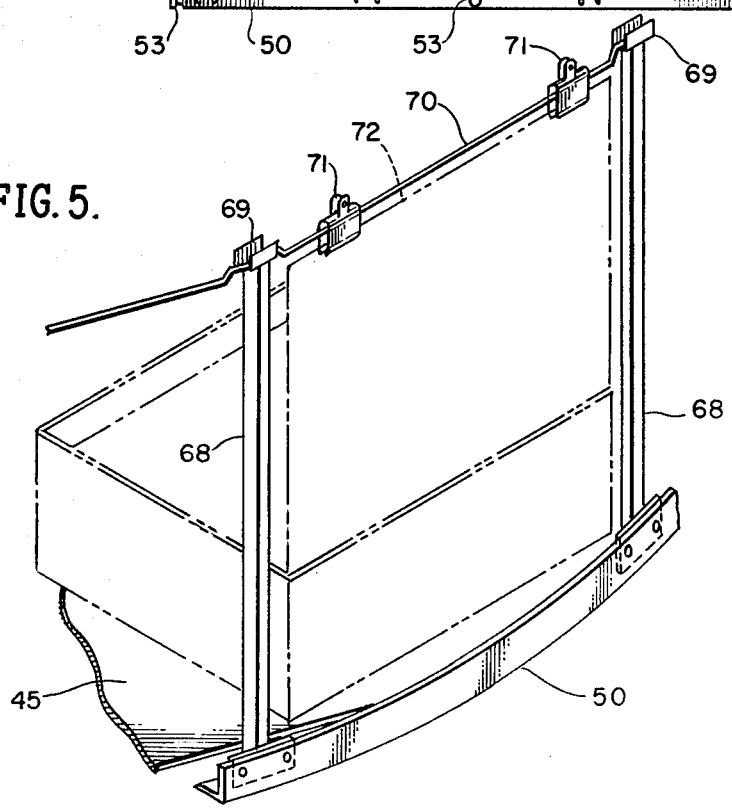
FIG. 5 is a fragmentary view in perspective of portions of the hangers and deck in association with a form box and form end shown in broken lines.

In the use of the cabinet of the present invention boxes 74 (FIG. 1) of forms are introduced through the door opening 17 and placed, four on the upper deck 45, equidistantly spaced, and four on the lower deck 60 also equidistantly spaced, but rotationally offset by 45 degrees from the boxes on the upper deck. This offsetting permits the form web 75 (FIG. 2) from boxes on the lower deck 60 to be drawn upwardly between the ends of the boxes on the upper deck 45 where the web's end 72 is held by clips 71 (FIGS. 4 and 5). The webs from boxes on the upper deck are similarly drawn upwardly to a position in which they are held by clips 71.

When it is desires to feed one of the eight webs of forms into the printer, the turntable structure is rotated, as by reaching in through door opening 17, until the clip-held end of that web is beneath the slot opening 18. The operator then grasps the web end through the slot opening, releases it from the clips 71 and feeds it into the printer. When it is desired to change forms, the web removed from the printer is lowered through the slot opening and its end is secured by the clips 71. The turntable then is rotated to bring the next selected form beneath the slot opening and it is fed to the printer as has been described.

I claim:

1. A cabinet for storing and selectively dispensing a variety of paper supplies comprising an enclosure presenting a horizontal top adapted to support the printer of a computer system and vertical side enclosure means including an access opening, a turntable structure within said enclosure comprising a horizontal deck rotatably mounted centrally of the interior of said enclosure and presenting a plurality of spaced stations for holding boxes of webbed forms; said horizontal top having a slot opening therein positioned overlying said deck adjacent its outer edge, whereby any of a variety of paper supplies carried on said deck may be positioned beneath said slot, manually retrieved through said slot and fed through said slot to a printer supported on said horizontal top, and means for supporting the free end of each of a plurality of webs of forms adjacent the under side of said top in radial congruity with said slot comprising a frame having a horizontal member and clip means carried by said member for retaining the free ends of said webs.

2. A cabinet for storing and selectively dispensing a variety of paper supplies comprising an enclosure presenting a horizontal top adapted to support the printer of a computer system and vertical side enclosure means including an access opening, a turntable structure within said enclosure comprising a pair of vertically separated horizontal decks rotatably mounted centrally of the interior of said enclosure; each of said decks presenting four circumferentially equally spaced stations for holding boxes of webbed forms and the stations of one deck being rotationally offset forty-five degrees from those of the other deck; said horizontal top having a slot opening therein positioned overlying said decks adjacent their outer edges whereby any of a variety of paper supplies carried on said decks may be positioned beneath said slot and fed through said slot to a printer supported on said horizontal top.

3. A cabinet according to claim 2 including additionally means for supporting the free end of each web of forms adjacent the under side of said top in radial congruity with said slot comprising a frame having a horizontal member and clip means carried by said member for retaining the free ends of said webs.

* * * * *